US006299509B2

(12) United States Patent
Wheat et al.

(10) Patent No.: US 6,299,509 B2
(45) Date of Patent: Oct. 9, 2001

(54) TUMBLE MEDIUM AND METHOD FOR SURFACE TREATMENT

(75) Inventors: Gary E. Wheat; Robert K. Patterson, both of Madisonville; Linda R. Crenshaw, Princeton, all of KY (US); Jon C. Schaeffer, Milford, OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/766,099

(22) Filed: Jan. 19, 2001

Related U.S. Application Data

(62) Division of application No. 08/924,367, filed on Sep. 5, 1997, now Pat. No. 6,220,947.

(51) Int. Cl.[7] ..... B24B 1/00
(52) U.S. Cl. ..... 451/32; 451/326
(58) Field of Search ..... 451/326, 32, 33, 451/34, 35, 327, 328, 329, 330

(56) References Cited

U.S. PATENT DOCUMENTS

| | | | |
|---|---|---|---|
| 2,947,124 | 8/1960 | Madigan et al. | 51/282 |
| 3,239,970 | 3/1966 | Bishop | 51/313 |
| 4,712,333 | 12/1987 | Lofton | 51/164.5 |
| 5,090,870 | 2/1992 | Gilliam | 416/241 R |
| 5,447,465 | 9/1995 | Samsel et al. | 451/32 |
| 5,460,566 | 10/1995 | Trahan | 451/326 |
| 5,525,135 | 6/1996 | Moltgen | 51/309 |
| 5,669,941 | 9/1997 | Peterson | 51/295 |

OTHER PUBLICATIONS

*Tool and Manufacturing Engineers Handbook*, Third Edition, Society of Manufacturing Engineers, published by McGraw–Hill Book Company, chapter 24, "Surface Preparation," Section on Barrel and Vibratory Finishing; pages 24–13 through 24–26.

*Primary Examiner*—Derris H. Banks
(74) *Attorney, Agent, or Firm*—Andrew C. Hess; Gerry S. Gressel

(57) ABSTRACT

A tumble medium for surface treatment of an article having a first radiographic signature comprises material having a second radiographic signature different from the first radiographic signature sufficient to enable radiographic detection of the material as distinct from the article. The tumble medium is used in a method for treatment of a surface of an article including there through openings communicating with an interior of the article. After tumbling, the article is inspected by radiography to detect any tumble medium within the interior of the article.

7 Claims, No Drawings

TUMBLE MEDIUM AND METHOD FOR SURFACE TREATMENT

This is a division of patent application Ser. No. 08/924,367, filed Sep. 5, 1997 now U.S. Pat. No. 6,220,947.

BACKGROUND OF THE INVENTION

This invention relates to the surface treatment of an article by the tumble process, and, more particularly, to a tumbling method and tumble medium having a radiographic signature different from that of the article.

The tumble process has been used for many years during the manufacture of a wide variety of articles for surface preparation or treatment. For example, tumbling has been used for abrading, polishing, rough cutting, deburring, edge radiusing, descaling, surface texture or property improvement, cleaning, and destressing, among others. Various types of tumbling systems used include barrel, vibratory, and centrifugal, alone or in combinations, with or without liquid. Certain components for gas turbine engines, for example blades, vanes and nozzles, are complex in shape and have precision requirements for surface finish, including edges. Therefore, it has been a practice to use the tumble process for surface treatment or preparation. Traditionally, such a process has been used primarily to remove burrs and for the rounding of sharp edges produced during manufacture, as well as to achieve required surface finish.

A detailed description of the tumble process is included in *Manufacturing Engineers Handbook,* Third Edition, published by McGraw-Hill Book Co. for the Society of Manufacturing Engineers. For example, details of processing, equipment and tumble media are included in Chapter 24 "Surface Preparation", section on Barrel and Vibratory Finishing found on pages 24-13 through 24-26. Typical U.S. Patents describing some facets of the tumbling process and various forms and shapes of tumble media pellets include U.S. Pat. No. 2,947,124—Madigan et al. (Aug. 2, 1960); U.S. Pat. No. 3,239,970—Bishop (Mar. 15, 1966); U.S. Pat. No. 4,712,333—Lofton (Dec. 15, 1987); and U.S. Pat. No. 5,090,870—Gilliam (Feb. 25, 1992); among others.

Modern gas turbine engine components, such as blades, vanes and nozzles operating in the higher temperature sections of the engine, for example the turbine section, are manufactured to include hollow interiors for air cooling. Internal air cooling passages frequently are labyrinthine in form and are connected through surface openings to the exterior of the component for the discharge of cooling air. Typical examples of such components are shown in U.S. Pat. No. 5,387,085—Thomas, Jr. et al. (Feb. 7, 1995); U.S. Pat. No. 5,458,461—Lee et al. (Oct. 17, 1995); and U.S. Pat. No. 5,503,529—Anselmi et al. (Apr. 2, 1996). In a typical tumble process, such components or parts are finished by immersing the parts in a container of abrasive media or stones, generally of a ceramic material. When a motion or vibration is imparted to the container, the media moves against the surface of the part, in this example made of a metal or metal alloy, and deburrs, finishes or otherwise treats the surface of the part. During the course of such a tumbling process, for example with an air cooled blade, root plugs in the blade dovetail holes through which cooling air is introduced into the blade can loosen and fall out during tumbling. Some of the media have been observed to wear or break into smaller pieces which have entered the internal cavities of the part, for example through such cooling air openings in the surface.

Conventional tumble media are made primarily of alumina and/or various silicates which are not detectable from the material of the part by radiography, one example of which is the x-ray technique. Another example is the detection of rays from radioactive substances. Tumble media remaining in the internal passages of such high temperature operating parts restrict the flow of cooling air, creating a "hot spot" that can lead to premature part failure.

BRIEF SUMMARY OF THE INVENTION

The present invention, in one form, provides a tumble medium for surface treatment of an article having a first radiographic signature. The tumble medium comprises a material having a second radiographic signature different from the first radiographic signature sufficient to enable radiographic detection of the material as distinct from the article.

In another form, the present invention provides a method for treatment of an article surface including there through openings communicating with an interior of the article. The article surface is tumbled with a media comprising the above described material; and thereafter it is inspected by radiography to detect any tumble media within the interior of the article.

DETAILED DESCRIPTION OF THE INVENTION

The problem of tumble media becoming lodged within an article during tumbling was discussed in the above identified U.S. Pat. No. 2,947,124—Madigan et al. Described in that patent is a tumble process which uses tumble pellets including a matrix which can be dissolved selectively from material of the article being tumbled. Detection of such lodged media is by visual observation or by shaking the article to hear entrapped particles. The above identified U.S. Pat. No. 4,712,333—Lofton includes a magnetic insert within non-magnetic tumbling media so as to render the media suitable for magnetic separation from non-magnetic workpieces.

In one form, the present invention provides a tumble medium which can be detected by radiography as distinct from an article, based on differences in radiographic signatures. One example of such differences in radiographic signatures is based on differences in radiographic densities or mass adsorption coefficients for use with an x-ray detection technique. Another example of such differences in radiographic signatures is based on relative differences in the amount of radioactive rays emitted from the materials involved. In the case of neutron radiography, the mass attenuation coefficient of the tumble medium is different from that of the article being treated. Providing a tumble medium having such radiographic signature differences compared with an article being treated enables detection of any particles of the medium within the interior of an article and a determination of whether further processing is required to remove such particles. Such removal has been accomplished by various means, one form of which is mechanical means, for example using a metal rod. Another form of removal is chemical leaching of the media.

Accordingly, as used herein, "radiographic signature" means the amount of rays or waves, as measured or detected by appropriate means, passed through or blocked by a material, as with x-rays or sonic waves, for example ultrasonics, or the amount of energy, such as radiation particles or waves, emitted from a material. For example, radiographic detection or measurement of the radiographic signature can be by well known instruments sensitive to such waves, rays or particles, by photosensitive film as with x-rays and radiation, etc.

One form of the tumble medium of the present invention having the above described difference in radiographic signature from that of the article being treated herein is called a radiopaque material or radiopaque medium, which does not allow the passage of x-rays or other radiation. Such radiopaque material for use with an x-ray technique includes materials having a locally larger concentration of atoms, with an atomic number significantly greater than the atomic number of the base element of the article being treated.

During evaluations of the present invention, radiopaque tumble medium for use in the tumble method on articles made from a Ni base alloy and for detection by an x-ray technique was made by adding to commercially available tumble media particles of a material having a radiographic density greater than the radiographic density of the Ni base alloy. Such addition to conventional tumble media can be made in a variety of ways including inserts within, particles mixed with, or surface treatment of the media. Examples of such materials include heavy elements such as Hf, Ta, W, Pd, Au, Cd, Sn, Pb, Ba, La, Re, Y, Gd, Pt, and their stable compounds such as oxides, sulfides, sulfates, nitrides, borides, etc., and their mixtures and combinations. For example, such compounds include solids like hafnium oxide, hafnium nitride, tantalum pentoxide, tungsten trioxide, cadmium oxide, lead monoxide, ceric oxide, barium sulfate, lead sulfate, lead sulfide and zirconium orthosilicate, as well as liquids like tungsten nitrate, and gadolinium nitrate. Compounds for testing were selected for stability, relatively large x-ray cross section relative to the article being treated, as well as for health, cost and safety considerations. Examples of other materials having a radioactive emission different from the Ni base alloy are uranium and thorium compounds, such as thorium oxide.

In one series of evaluations, the radiopaque materials were substantially pure particles of hafnium oxide, of barium sulfate and of zirconium orthosilicate, each disposed separately in small individual plastic bags. The bags each were placed air cooled gas turbine blades of the type shown in the above identified U.S. Pat. No. 5,458,461—Lee et al., made of a Ni base superalloy commercially known as Rene' 142 alloy, forms of which are described in U.S. Pat. No. 4,169,742—Wukusick et al., patented Oct. 2, 1979. The blades were x-rayed by the standard technique used commercially for such parts. Visual evaluation of the x-ray film revealed that all three radiopaque materials could be seen readily on the x-ray film, but that hafnium oxide produced a greater radiographic signature based on density on the film. Also, commercial tumble media separately coated with each of the above three radiopaque compounds, at a concentration in the range of about 0.5–1 vol. %, were placed within the same type of blades. X-ray evaluations of the blades revealed, again, that all were readily detectable, but that, of the three compounds, hafnium oxide produced the greatest radiographic signature based on density on the x-ray film.

Based on the results of these initial evaluations, radiopaque tumble medium samples were prepared by dispersing hafnium oxide powder uniformly with a steatite tumble media powder of magnesium silicate and clay. Samples of tumble media with, by volume, of about 0.1%, 0.5%, 1%, 5%, and 10% hafnium oxide were prepared by pressing the mixture into pellets and firing in a kiln to vitrify the pellets into ceramic bodies. The pellets then were broken into small pieces and placed within the airfoils of scrap air cooled turbine blades of the above type. The blades were x-rayed using a standard commercial technique and the radiographic densities were compared visually. The results of this evaluation showed that for hafnium oxide along with the media and x-ray technique used, amounts of up to about 1 vol. % hafnium oxide were difficult to distinguish on film. However, hafnium oxide at about 5% and 10% amounts showed excellent radiographic densities and were easy to distinguish within the blade cavities.

The tumble medium of the present invention can be up to substantially 100% of the radiopaque material for some uses. Selection of the concentration of such material used for a particular application includes consideration of how the weight factor of the media will be affected. For example, it can affect the media's cutting ability, its chipping factor, and the surface finish achieved for a selected tumble cycle. The above evaluations revealed that pellets with about 10 vol. % hafnium oxide in a ceramic matrix, chipped more readily when used with Ni base alloy articles. It is believed that such an addition to ceramic type tumble media for that use approaches a concentration of addition at which properties of such media can be affected adversely for tumbling purposes. Therefore, a preferred form of the tumble medium of the present invention includes up to about 10 vol. % of radiopaque material with the balance essentially a ceramic.

In another evaluation of the present invention, pellets of tumble medium were made as described above using a mixture, by volume, of about 3% hafnium oxide and about 5% zirconium orthosilicate uniformly dispersed in each of two forms of an aluminum oxide type of tumble media marketed by Wisconsin Porcelain of Sun Prairie, Wis. as XC media and ECH media. In addition, about 5 vol. % of hafnium oxide was uniformly dispersed with the XC media. After the firing process, the types of pellets were broken into small pieces and placed within the scrap blades as described above. For both the XC media and ECH media which included the above combination of hafnium oxide and zirconium orthosilicate, the radiographic densities on x-ray film were generally the same as that of the 5 vol. % hafnium oxide in the XC media: all were readily detectable from the blade. The mixture of hafnium oxide and zirconium orthosilicate enabled use of a radiopaque material in a tumble medium, according to the present invention, at a lower cost than use of hafnium oxide alone.

The present invention has been described in connection with various specific examples, embodiments and combinations. However, it will be understood by those skilled in the arts involved that this invention is capable of a variety of modifications, variations and amplifications without departing from its scope as defined in the appended claims.

What is claimed is:

1. A method for treating a surface of an article having a first radiographic signature, wherein the surface includes through openings communicating with an interior of the article, the method comprising the steps of:

providing a tumble medium comprising a material having a second radiographic signature different from the first radiographic signature;

tumbling the surface with the tumble medium; and inspecting the article by radiography to detect any tumble medium within the interior of the article.

2. The method of claim 1 wherein the material is a radiopaque.

3. The method of claim 1 wherein the article is metallic.

4. The method of claim 1 wherein the step of inspecting comprises x-ray inspection.

5. The method of claim 1 wherein the tumble medium comprises by volume greater than 1% hafnium oxide.

6. The method of claim 1 wherein the tumble medium comprises between about 3% and about 10% by volume hafnium oxide in a ceramic matrix.

7. The method of claim 1 wherein the tumble medium comprises hafnium oxide and zirconium orthosilicate.

* * * * *